US006199665B1

(12) United States Patent
Eilerman et al.

(10) Patent No.: US 6,199,665 B1
(45) **Date of Patent: *Mar. 13, 2001**

(54) STRADDLE ARM FOR FORK LIFT TRUCK

(75) Inventors: Robert L. Eilerman, Ft. Loramie, OH (US); Robert J. Henshaw, Evanston, IL (US); Patrick A. Tebbe, Anna, OH (US)

(73) Assignee: Crown Equipment Corporation, New Bremen, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/176,856

(22) Filed: Oct. 22, 1998

Related U.S. Application Data

(60) Provisional application No. 60/065,044, filed on Nov. 11, 1997.

(51) Int. Cl.[7] ..... B66F 9/06

(52) U.S. Cl. ..... 187/232; 187/231; 187/237

(58) Field of Search ..... 187/222, 231, 187/232, 237, 238

(56) References Cited

U.S. PATENT DOCUMENTS

| | | | | |
|---|---|---|---|---|
| 2,925,887 | * | 2/1960 | Gibson | 187/232 |
| 4,061,237 | * | 12/1977 | Austin et al. | 187/231 X |
| 5,174,415 | * | 12/1992 | Neagle et al. | 187/231 |
| 5,722,511 | * | 3/1998 | Wakamiya | 187/231 |
| 5,738,187 | * | 4/1998 | Dammeyer et al. | 187/222 |
| 5,848,668 | * | 12/1998 | Kafrissen et al. | 187/237 |
| 5,890,562 | * | 4/1999 | Bartels et al. | 187/222 |

FOREIGN PATENT DOCUMENTS

| | | | | |
|---|---|---|---|---|
| 2628087 A1 | * | 9/1989 | (FR) | 187/237 |

* cited by examiner

*Primary Examiner*—Robert P. Olszewski
*Assistant Examiner*—Thuy V. Tran
(74) *Attorney, Agent, or Firm*—King & Schickli PLLC

(57) ABSTRACT

Each straddle arm of a lift truck is formed from a cylindrical section of steel pipe or tubing which is continuous in its circumference, to evenly distribute the torque which is transferred from a forwardly extending portion of the straddle arm to a mast assembly of the truck.

6 Claims, 4 Drawing Sheets

STRADDLE ARM FOR FORK LIFT TRUCK

CROSS REFERENCE TO RELATED APPLICATIONS

This application claims the benefit of U.S. Provisional Patent Application Ser. No. 60/065,044 filed Nov. 11, 1997 and entitled IMPROVED STRADDLE ARM FOR RIDER REACH FORK LIFT TRUCK which is incorporated herein by reference.

BACKGROUND OF THE INVENTION

The present invention relates in general to fork lift trucks and, more particularly, to an improved straddle arm for supporting the forward end of such trucks while permitting free movement of forks carried by the trucks. While the present invention is generally applicable to fork lift trucks, it is described herein with reference to a rider reach fork lift truck, for which it is particularly applicable and initially being used.

Rider reach fork lift trucks are typically provided with a pair of forwardly extending straddle arms mounted outside the forks where they do not impede the lowering of the forks, and any load supported upon the forks, to the floor. The straddle arms carry one or more wheels to support the weight of the truck of course including any load carried by the forks. In prior art trucks, straddle arms are attached to a truck by means of a lateral member which is typically a box structure formed by a pair of L-shaped or U-shaped steel components welded together.

FIG. 1 shows one example of prior art straddle arm construction. A straddle arm 1 is welded to a lateral member 2 which in turn is welded to a mast assembly 3 at the forward end of a power unit 4. The lateral member 2 is made of two components which are welded together at the front 5 of the lateral member 2 and at the rear 6 of the lateral member in substantially the same manner. The truck supporting force applied to wheels at the forward end of the straddle arm 1 results in a considerable amount of torque being transferred through the lateral member 2 to the mast assembly 3 such that the lateral member 2 must be substantial and securely welded .

There is an ongoing need to improve lift truck design to provide more efficient structure s and manufacturing techniques.

SUMMARY OF THE INVENTION

With regard to straddle arms for lift trucks, this need is currently met by the invention of the present application wherein the lateral member of each straddle arm is formed from a cylindrical section of steel pipe or tubing. Advantageously, the cylindrical tubing section is continuous in its circumference, thereby evenly distributing the torque which is transferred from the forwardly extending portion of the straddle arm to the mast assembly. Further, the cylindrical tubing section does not have to be constructed by welding two components together so that it eliminates the two weldments necessary for construction of the prior art lateral member and thereby reduces the time of construction. As an additional advantage, the straddle arm of the present application presents a smooth, rounded shape at the point of attachment of the arm to the mast assembly which is visually appealing.

In accordance with one aspect of the present invention, a fork lift truck comprises power unit and a mast assembly secured to the power unit. A pair of forks are mounted to the mast assembly and movable in height between a lowered position and plurality of raised positions. A pair of straddle arms are spaced outwardly from the forks and secured to opposite sides of the mast assembly. Each of the straddle arms comprises an arm member extending forwardly from the power unit, and a lateral cylindrical member extending axially between the arm member and the mast assembly to couple the arm member to the mast assembly. Each of the straddle arms may further comprise a torque arm coupled between the arm member and the lateral cylindrical member.

Preferably, the torque arm comprises a teardrop shaped solid steel member having a rounded end which tapers to a generally pointed end, the member including a cutout toward the generally pointed end for receiving the arm member. The arm member and the torque arm are welded together such that an inside surface of the arm member and an inside surface of the torque arm are flush with one another to define an inner surface for engaging the lateral cylindrical member. A first end of the lateral cylindrical member is welded to the inner surface and a second end of the lateral cylindrical member is welded to the mast assembly. The first and second ends of the lateral cylindrical member can be beveled to facilitate welding the lateral cylindrical member to the mast assembly and to the surface of the arm member and the torque arm.

In accordance with another aspect of the present invention, a straddle arm for a fork lift truck comprises an elongated arm member, a cylindrical member, and a torque arm coupled to the arm member and the cylindrical member. Preferably, the torque arm is a teardrop shaped solid steel member having a rounded end and a pointed end and including a cutout in the pointed end for receiving the elongated arm member therein. The elongated arm member and the torque arm are combined and welded together to form a surface for engaging a first end of the cylindrical member. The first end of the cylindrical member is welded to the surface formed by combining the elongated arm member and the torque arm. Both the first end of the cylindrical member and a second end thereof can be beveled to facilitate welding at the first and second ends.

In accordance with still another aspect of the present invention, a method of making a fork lift truck comprises providing a power unit and securing a mast assembly to the power unit. A pair of forks are mounted to the mast assembly for movement in height between a lowered position and a plurality of raised positions. A cylindrical member is secured to each side of the mast assembly so that axes of the cylindrical members are generally horizontal and the cylindrical members extend outwardly from the mast assembly. An arm member is coupled to each of the cylindrical members so that the arm members are spaced outwardly from the forks. Preferably, the step of coupling an arm member to each of the cylindrical members comprises providing a teardrop shaped torque arm member having a rounded end which tapers to a generally pointed end and forming a cutout in the torque arm toward the generally pointed end for receiving the arm member. The arm member is welded to the torque arm with an inside surface of the arm member and an inside surface of the torque arm being flush with one another to define an inner surface for engaging the cylindrical member. The cylindrical member is welded to the inner surface. Preferably, the method further comprises beveling first and second ends of the cylindrical members to facilitate welding the cylindrical members It is, thus, an object of the present invention to provide an improved straddle arm for a fork lift truck including a cylindrical member for coupling an arm member to a mast assembly of the truck.

Other objects and advantages of the invention will be apparent from the following description, the accompanying drawings and the appended claims.

DETAILED DESCRIPTION OF THE INVENTION

Figure 1:
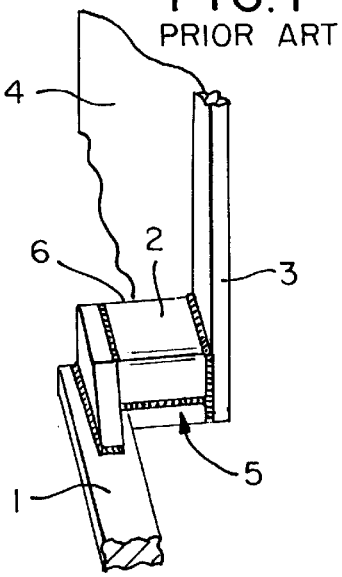
FIG. 1 PRIOR ART
FIG. 1 is a perspective view of a prior art straddle arm construction for a fork lift truck.
Figure 2:
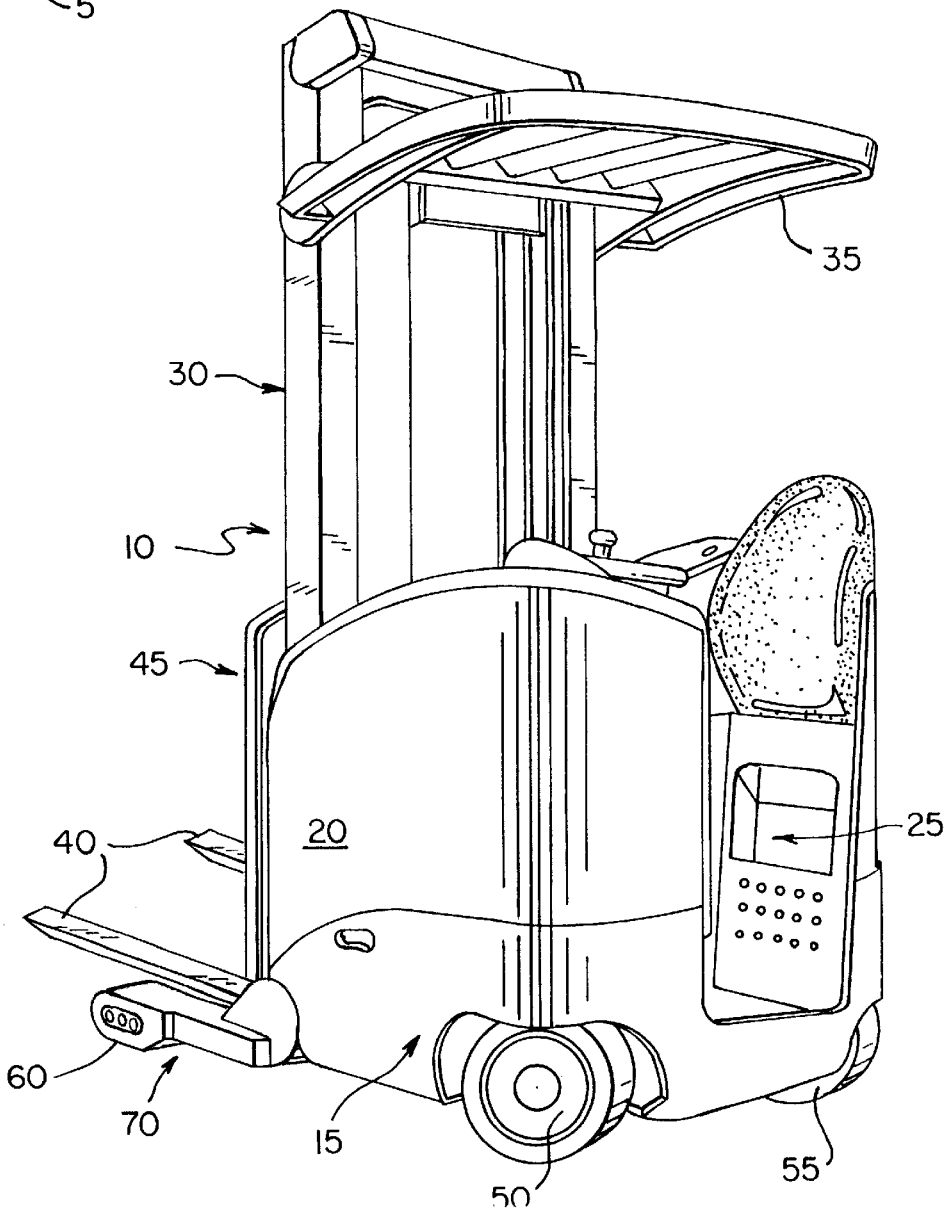
FIG. 2 is a perspective view of a rider reach fork lift truck incorporating the present invention.
Figure 3:
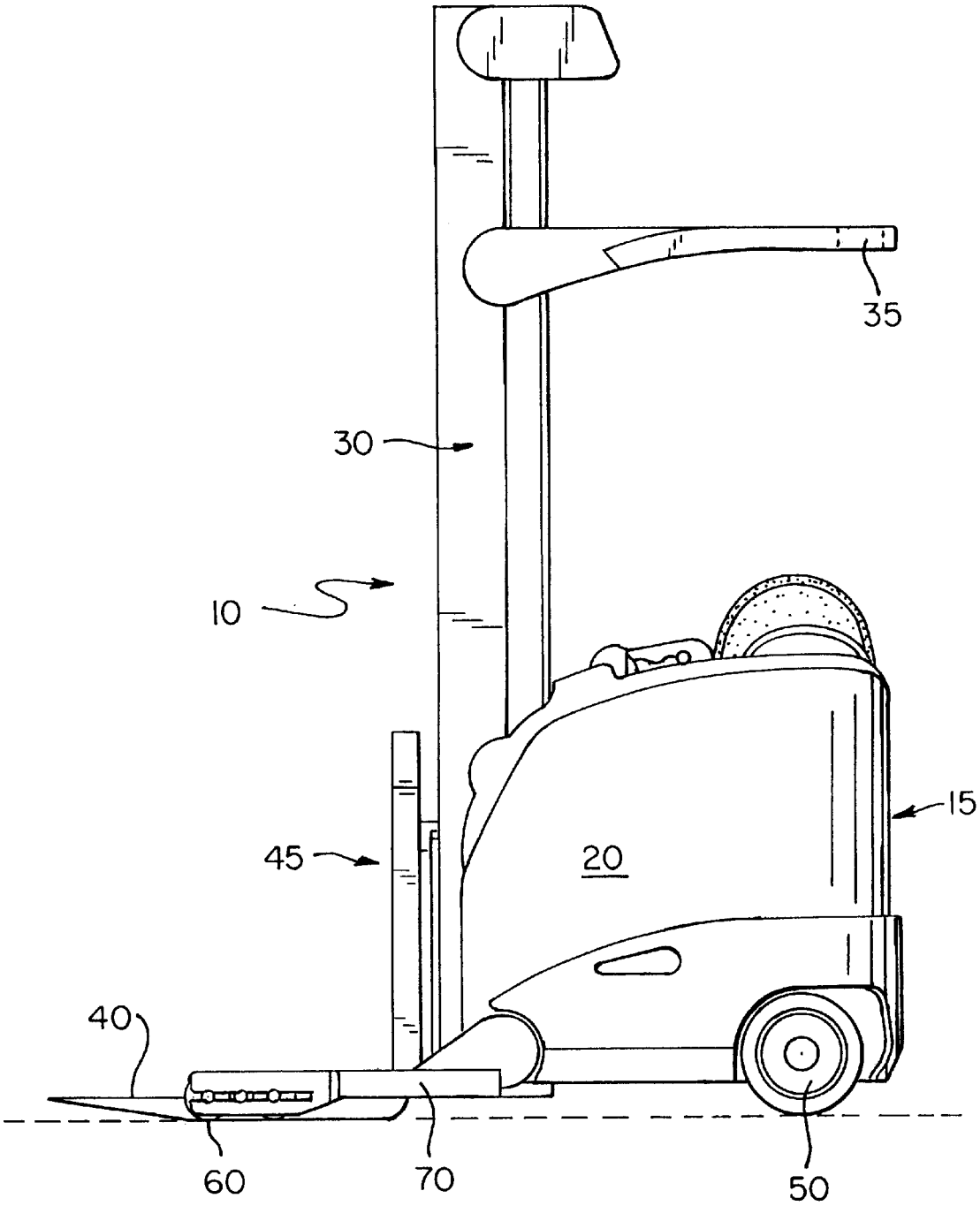
FIG. 3 is a side elevational view of the rider reach truck of FIG. 2.

FIGS. 2 and 3 show a rider reach truck 10, specifically a 42 inch wide model 5000 rider reach truck manufactured by Crown Equipment Corporation. The truck 10 includes a power unit 15 including a battery compartment 20, an operator's compartment 25, a mast assembly 30, an overhead guard 35, and a pair of forks 40 carried by a fork carriage mechanism 45.

The truck 10 is supported at four points which are provided by a steerable, powered wheel 50 located at the left rear of the power unit 15 as shown in FIG. 2., a caster wheel 55 located at the right rear of the power unit 15 as shown in FIG. 2, and two sets of outrigger wheels 60 supported on a pair of straddle arms 70 (only one of which, the left straddle arm, is shown in the drawings) extending from the mast assembly 30 at the front of the truck 10. The straddle arms 70 are attached at the lower end of the mast assembly 30 and extend laterally outwardly to allow the forks 40, and any loads/pallets carried thereby, to be lowered to the floor between the straddle arms 70 without interference.

Figure 4:
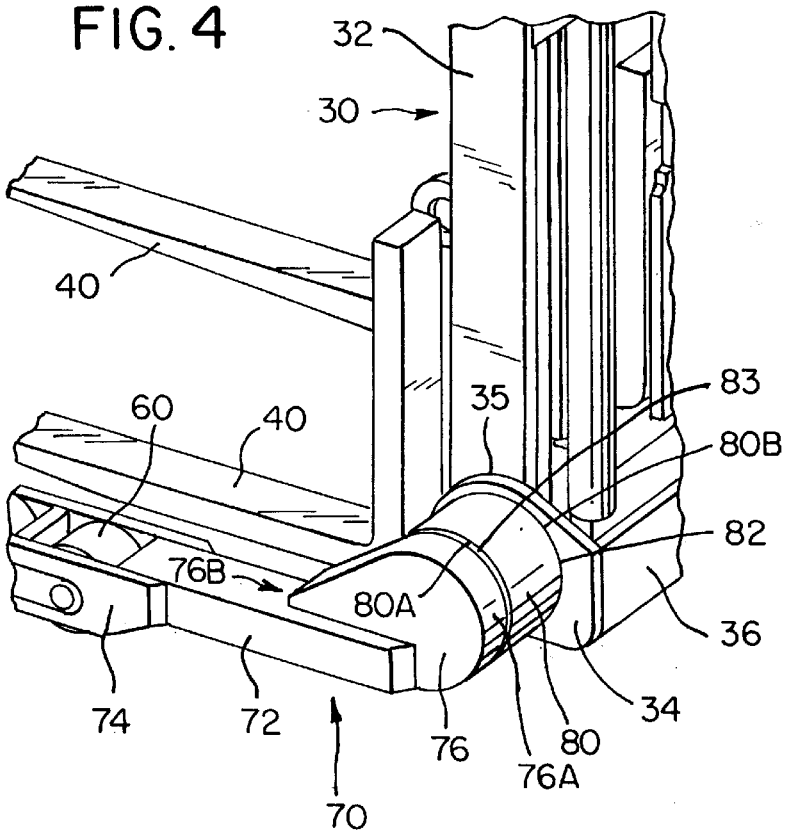
FIG. 4 is a rear perspective view of the left straddle arm and mast assembly of the rider reach truck of FIG. 2.
Figure 5:
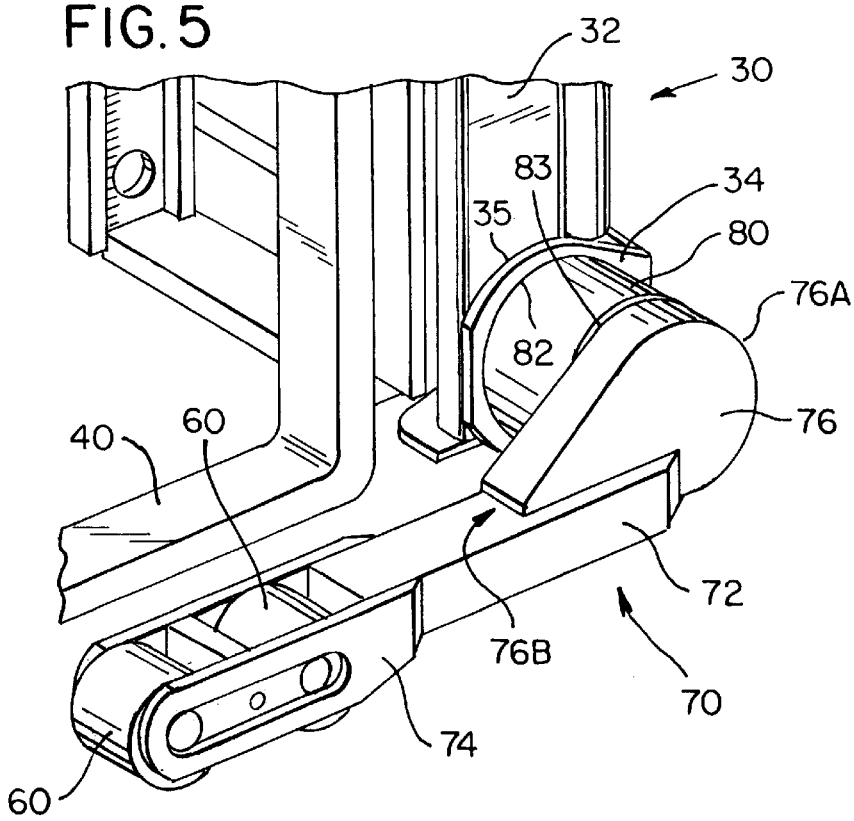
FIG. 5 is a front perspective view of the left straddle arm and mast assembly of the rider reach truck of FIG. 2.
Figure 6:
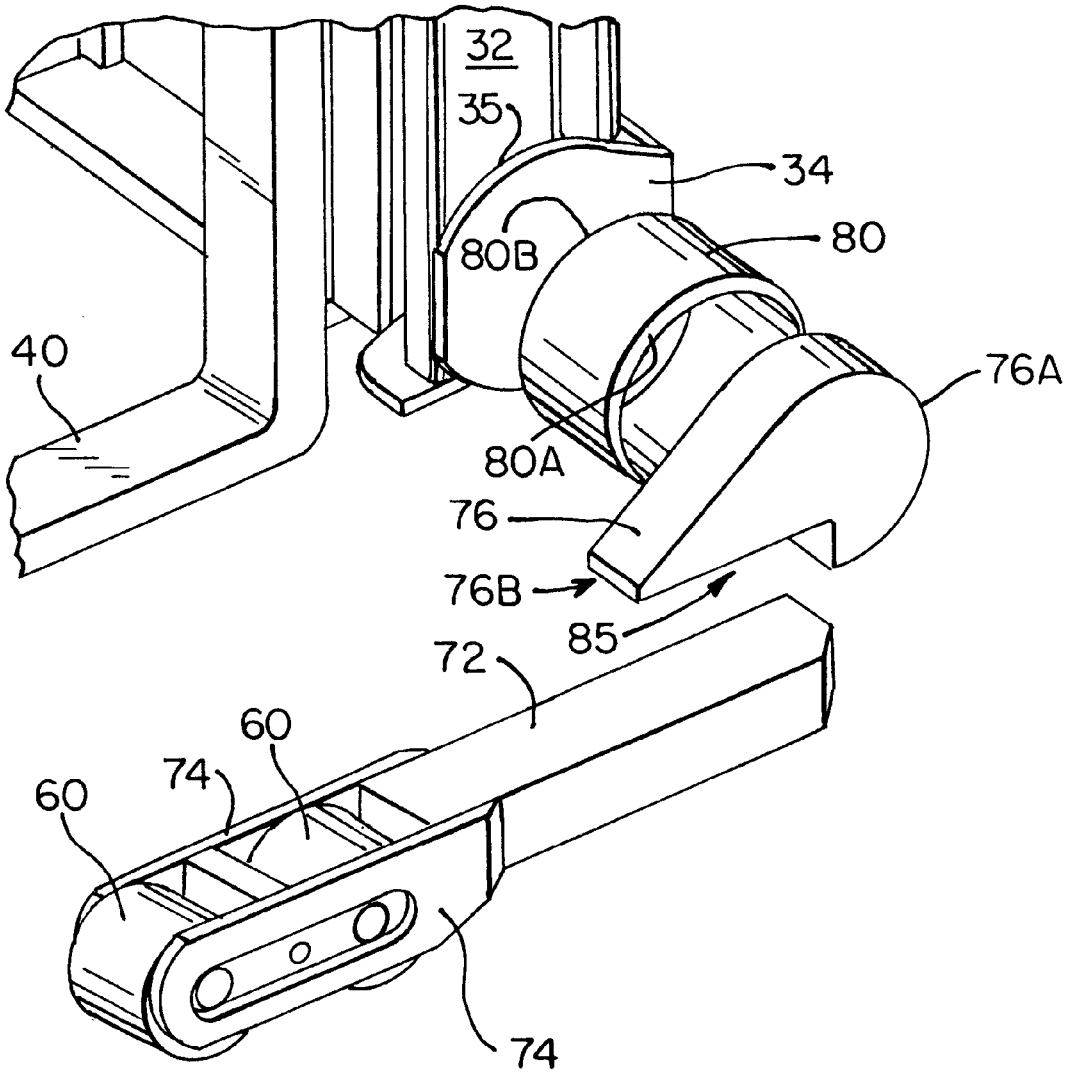
FIG. 6 is an exploded front view of the left straddle arm of the rider reach truck of FIG. 2 with the mast assembly.

As shown in FIGS. 4–6, each of the straddle arms 70 is formed from a forwardly extending solid steel bar or arm member 72. A pair of bearing plates 74 is attached to the forward end of the arm member 72 with wheels 60 supported for rotation between the pair of bearing plates 74. A torque arm 76 is coupled between the arm member 72 and the mast assembly 30 and, as shown in FIGS. 4–6, is teardrop shaped having a rounded end 76A which tapers to a generally pointed end 76B. The torque arm 76 is a solid steel component, approximately 3 inches thick, that includes a cut-out 85 into which the forwardly extending arm 72 is placed and then welded to the torque arm 76.

In the illustrated embodiment, the mast assembly 30 includes a vertically extending member, a side plate 34 and a transverse plate 36. The side plate 34 is welded to the vertical member 32 around its periphery illustrated at 35 and plates 34 and 36 are welded together. A lateral cylindrical member 80 extends between the arm member 72 and the mast assembly 30. When the arm member 72 and the torque arm 76 are welded together, an inside surface of the arm member 72 and an inside surface of the torque arm 76 are flush with one another to define an inner surface for engaging the cylindrical member 80. The inside surfaces of the torque arm 76 and the arm member 72, i.e., the inner surface, is welded to a first end 80A of the cylindrical member 80 around its periphery illustrated at 83 while a second end 80B of the cylindrical member 80 is welded to the mast assembly 30 or, more precisely for the illustrated embodiment, to the side plate 34 around its periphery illustrated at 82. Preferably, the ends 80A, 80B of the cylindrical member 80 are beveled to facilitate welding the cylindrical member 80 to the plate 34 and to the inside surfaces of the torque arm 76 and the arm member 72, see FIG. 6.

The torque arm 76 and cylindrical member 80 thus transfer weight from the wheels 60 at the forwardly extending portion of the straddle arm to the mast assembly 30 with the torque being evenly distributing by the construction of the straddle arm of the present application.

Thus, in the present invention, a strong, visually appealing straddle arm is provided, which requires fewer assembly steps than the prior art.

Having thus described the invention of the present application in detail and by reference to preferred embodiments thereof, it will be apparent that modifications and variations are possible without departing from the scope of the invention defined in the appended claims.

What is claimed is:

1. A fork lift truck comprising:

a power unit;

a mast assembly secured to said power unit;

a pair of forks mounted to said mast assembly, said forks being movable in height between a lowered position and a plurality of raised positions; and a pair of straddle arms spaced outwardly from said forks and being immovably secured to opposite sides of said mast assembly, each of said straddle arms comprising:

an arm member extending forwardly from said power unit; and a lateral cylindrical member extending axially between said arm member and said mast assembly to couple said arm member to said mast assembly, said lateral cylindrical member being immovably secured to said mast assembly and said arm member.

2. A fork lift truck as claimed in claim 1 wherein each of said straddle arms further comprises a torque arm immovably secured between said arm member and said lateral cylindrical member.

3. A fork lift truck as claimed in claim 2 wherein said torque arm comprises a teardrop shaped solid steel member having a rounded end which tapers to a generally pointed end, said solid steel member including a cutout toward said generally pointed end for receiving said arm member.

4. A fork lift truck as claimed in claim 3 wherein said arm member and said torque arm are welded together, an inside surface of said arm member and an inside surface of said torque arm being flush with one another to define an inner surface for engaging said lateral cylindrical member.

5. A fork lift truck as claimed in claim 4 wherein a first end of said lateral cylindrical member is welded to said inner surface and a second end of said lateral cylindrical member is welded to said mast assembly to said mast assembly.

6. A fork lift truck as claimed in claim 5 wherein said first and second ends of said lateral cylindrical member are beveled to facilitate welding said lateral cylindrical member to said mast assembly and to said inner surface.

* * * * *

UNITED STATES PATENT AND TRADEMARK OFFICE

CERTIFICATE OF CORRECTION

PATENT NO. : 6,199,665 B1
DATED : March 13, 2001
INVENTOR(S) : Robert L. Eileran, Robert J. Henshaw, Patrick A. Tebbe It is certified that error appears in the above-identified patent and that said Letters Patent is hereby corrected as shown below:

Column 1,
Line 41, "structure s" should read -- structures --.
Line 61, "comprises power unit" should read -- comprises a power unit --.

Column 2,
Line 2, "and plurality" should read -- and a plurality --.

Column 4, claim 5,
Line 59, "to said mast assembly to mast assembly." should read -- to said mast assembly. --

Signed and Sealed this

Nineteenth Day of March, 2002

*Attest:*

*Attesting Officer*

JAMES E. ROGAN
*Director of the United States Patent and Trademark Office*